US005800775A

United States Patent [19]

Vihnicka et al.

[11] Patent Number: 5,800,775

[45] Date of Patent: Sep. 1, 1998

[54] REFRACTORY BLOCK SLAG DAM

[75] Inventors: Robert S. Vihnicka, Aurora; Richard L. Meskimen, Morris, both of Ill.

[73] Assignee: Commonwealth Edison Company, Chicago, Ill.

[21] Appl. No.: 760,943

[22] Filed: Dec. 9, 1996

[51] Int. Cl.[6] ..... C21B 3/04

[52] U.S. Cl. ..... 266/230; 266/283; 266/229

[58] Field of Search ..... 266/45, 236, 229, 266/230, 227, 241, 283; 432/233, 238

[56] References Cited

U.S. PATENT DOCUMENTS

| | | | |
|---|---|---|---|
| 2,071,890 | 2/1937 | McWane | 266/229 |
| 3,217,458 | 11/1965 | Freeman | 266/283 |
| 4,095,777 | 6/1978 | Honaker | 266/45 |
| 4,456,231 | 6/1984 | Bergsoe | 266/229 |
| 4,725,045 | 2/1988 | Cutre et al. | 266/230 |
| 4,936,553 | 6/1990 | Smith | 266/45 |
| 5,083,754 | 1/1992 | Russo | 266/230 |
| 5,171,513 | 12/1992 | Vassilicos | 266/230 |
| 5,246,483 | 9/1993 | Streets | 266/227 |
| 5,378,260 | 1/1995 | Cox et al. | 75/500 |

OTHER PUBLICATIONS

SHAMVA catalogue, Mullite Refractory Brick & Special Shapes, Cat. No. 102 H.K. Porter Company, INC. Jan., 1958.

*Primary Examiner*—Scott Kastler

*Attorney, Agent, or Firm*—Brinks Hofer Gilson & Lione

[57] ABSTRACT

A dam surrounding a slag tap on a refractory covered, boiler-tube floor for holding back a protective slag layer. The dam is comprised of a plurality of adjacent refractory blocks mechanically secured to the refractory covered, boiler-tube floor near the slag tap. Each refractory block is shaped to brace an adjacent refractory block against motion toward the slag tap. Additional dams are used when a single dam is not sufficient to cover the entire surface of the floor with slag.

20 Claims, 6 Drawing Sheets

2b
18a
2b
14
16
12

Fig. 2a
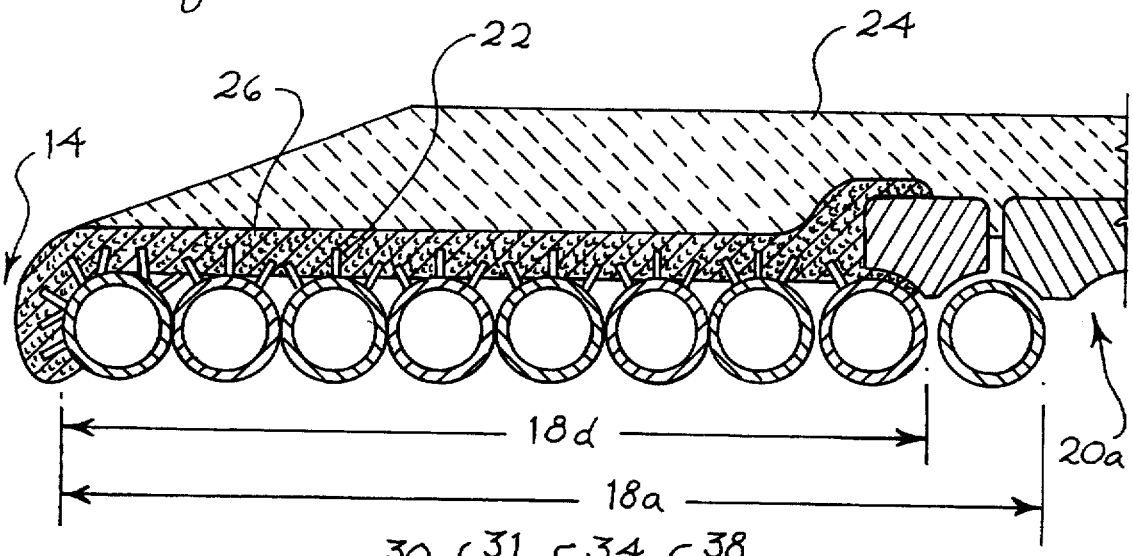
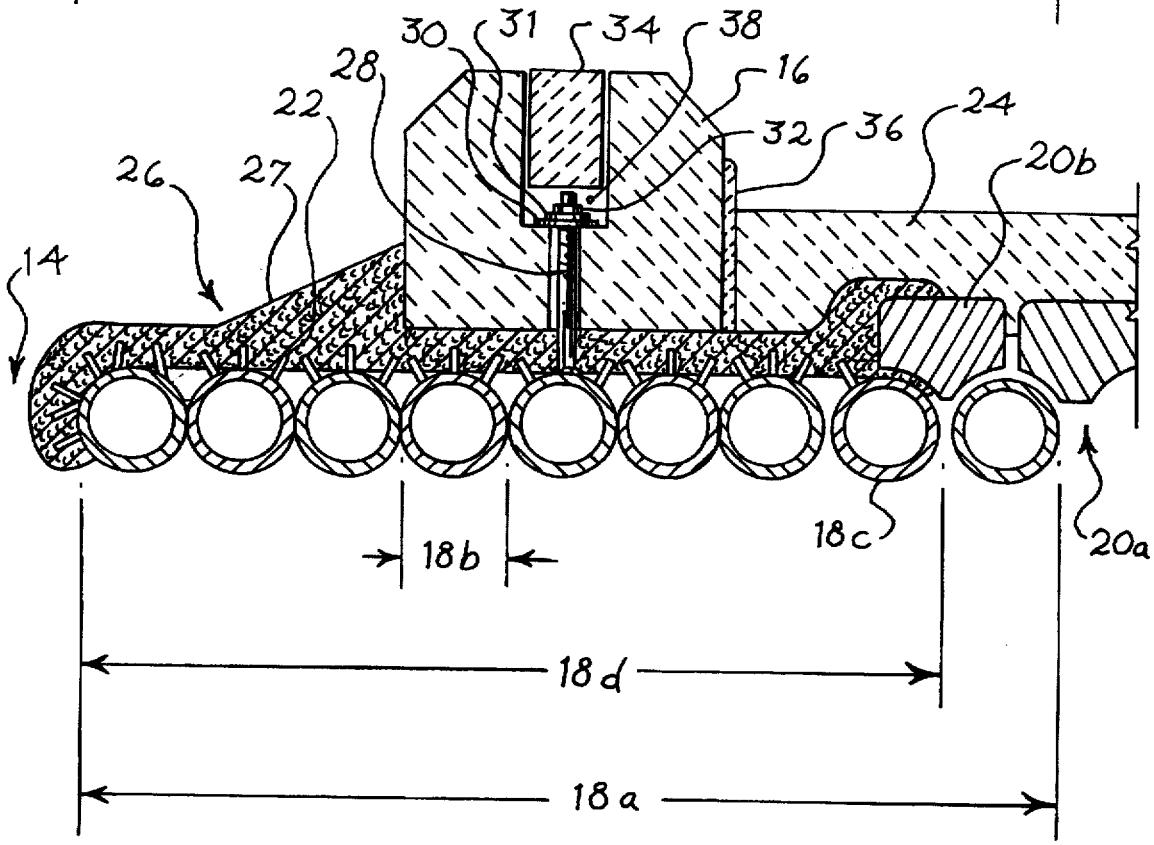
Fig. 2b

REFRACTORY BLOCK SLAG DAM

BACKGROUND OF THE INVENTION

This invention relates to an improved slag dam that reduces maintenance and operational problems encountered with furnaces having a water-cooled slag ring.

Some furnaces use water-cooled rings as slag dams to hold back a protective slag layer over a refractory covered, boiler-tube floor. If a constant layer of slag is held over the refractory covered floor, the slag will attack a small distance into the thickness of the refractory material and chill a thin layer of the refractory surface against further heat and slag attack. If a constant slag layer is not held, the refractory covering will be repeatedly attacked by heat and slag, greatly shortening its life and possibly leading to attack of the boiler-tube floor itself.

Because water-cooled rings are located at the edge of the slag taps, the slag taps are periodically bridged closed by frozen slag under certain operating conditions, and a magnesium rod is often used to burn open these frozen-over slag taps. The water-cooled ring's location with respect to the slag tap subjects the ring to damage from the magnesium rods during maintenance of the slag tap. The water-cooled rings also have experienced operational problems caused by inadequate cooling flow, seasonal fluctuations in water temperature, and absence of water flow at furnace start-up.

Water-cooled rings used as slag dams are such a high maintenance item that their use has been discontinued in some applications. Where the use of the rings has been discontinued, there has been a corresponding shortening of life of the protective floor refractory coatings, aggravated by recent OSHA restrictions on the use of chrome oxide refractory materials in these types of boilers. The present invention is directed to an improved furnace that reduces these maintenance and operational problems.

SUMMARY OF THE INVENTION

According to this invention, a slag dam comprising pre-fired refractory blocks positioned around a slag tap is provided in a furnace to hold back a protective layer of slag over a refractory covered, boiler-tube floor. The layer of slag protects the refractory covering against erosion from slag flowing toward the slag tap. Means are also provided for securing the refractory blocks to the boiler-tube floor as well as to other refractory blocks.

Other aspects of this invention relate to (1) a plurality of slag dams positioned to hold a layer of slag over boiler-tube floors of varied slopes, (2) the position of the slag dam with respect to the slag tap to avoid damage to the refractory blocks during maintenance of the slag tap and to reduce the chance of slag bridging the tap closed, and (3) a kit containing the necessary components to construct a slag dam at the furnace site.

BRIEF DESCRIPTION OF THE DRAWINGS

FIG. 2*a* is a sectional view of a furnace of the first preferred embodiment.

FIG. 2*b* is a sectional view taken along line 2*b*—2*b* of FIG. 1.

DETAILED DESCRIPTION OF THE PRESENTLY PREFERRED EMBODIMENTS

Figure 1:
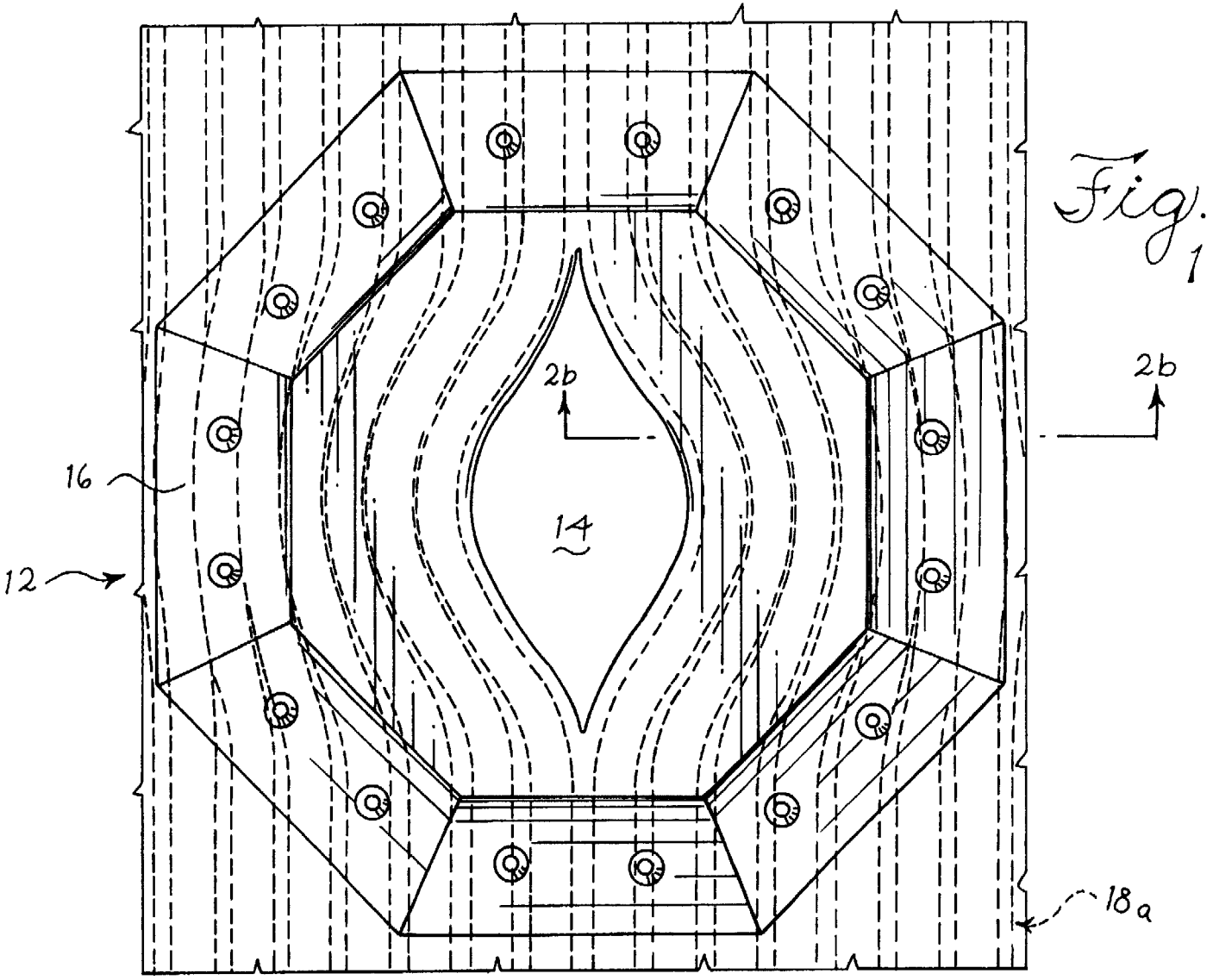
FIG. 1 is a plan view of a first preferred embodiment of the present invention.

Turning now to the drawings, FIG. 2*a* shows several components of a furnace of a first preferred embodiment. The furnace is a metal structure having a slag tap 14 on a bottom surface, a boiler-tube floor 18*a*, pin studs 22, Bailey blocks 20*a*, a plastic, rammable refractory material 26, and a pumpable refractory material 24. The bottom surface of the furnace slopes slightly toward the slag tap 14 and lies beneath the boiler-tube floor 18*a*. Pin studs 22 attach to part of the boiler-tube floor 18*a*, creating a section of studded boiler tubes 18*d*. The plastic, rammable refractory material 26 is rammed over the studded boiler tubes 18*d*.

Bailey blocks 20*a* attach over the remainder of the boiler-tube floor 18*a*. Bailey blocks 20*a* are not used near the slag tap 14 because there is a slag tank under the slag tap 14, making the attaching of the Bailey blocks 20*a* to that section of the boiler-tube floor 18*a* very difficult. A pumpable refractory material 24 extends from the walls of the furnace to the slag tap 14, lying over the Bailey blocks 20*a* and the plastic refractory 26.

The burning of combustible fuel in the furnace often produces slag which falls on the refractory covered, boiler-tube floor 18*a*. As used herein, the term "refractory covered" means the condition of being covered by a refractory material, such as, but not limited to, the pumpable refractory material 24 or the plastic, rammable refractory material 26. Because of the slope of the bottom furnace surface, the slag flows toward the slag tap 14, where it exits the furnace.

The slag and heat of the furnace are very damaging to the Bailey blocks 20*a* and the boiler-tube floor 18*a*, as well as to the bottom surface of the furnace. The pumpable refractory material 24 is capable of withstanding the extreme conditions of the furnace and shields the Bailey blocks 20*a* and the boiler-tube floor 18*a* from the heat. The boiler-tube floor 18*a* shuttles water of a temperature lower than that of the interior of the furnace, and it, with the pin studs 22 of the exposed boiler tubes 18*d*, cools the pumpable refractory material 24, further enhancing its resistance to the heat and slag. However, as slag flows toward the slag tap 14, it erodes the pumpable refractory material 24.

FIRST PREFERRED EMBODIMENT

FIG. 1 shows a plan view of a furnace that includes a first preferred embodiment of the present invention. In this embodiment, a slag dam 12 comprises a plurality of refractory blocks 16. The refractory blocks 16 are made from a high-fired, pre-fired refractory material capable of withstanding the extreme conditions of the furnace. Each block 16 has shaped ends, allowing a plurality of the blocks 16 to form a closed circuit, and has at least one recess 38 extending through the block 16 (see FIG. 2*b*). The shaped ends of each block 16 taper to brace each adjacent refractory block 16 against motion toward the slag tap 14.

The dam 12 prevents erosion of the pumpable refractory material 24 by holding a thick, constant layer of slag over it. With a thick, constant layer of slag held over the pumpable refractory material 24, the lower part of the slag layer penetrates into the refractory material 24, chilling and fusing a thin, protective coating at the bottom of the slag layer. This thin, protective coating protects the pumpable refractory material 24 below from the hot, active slag layer above. If a thick, constant slag layer is not held, the pumpable refractory material 24 will erode as slag flows toward the drain. This will leave the Bailey blocks 20*a* and the boiler-tube floor 18*a* vulnerable to direct heat and slag attack.

FIG. 2*b* illustrates how the block 16 is secured in place. A threaded fastener 28, a ceramic fiber washer 30, a metal washer 31, a nut 32, and a refractory plug 34 are used in each recess 38 to secure each refractory block 16 to the boiler-tube floor 18*a*.

The threaded fastener 28 is welded to a tube of the boiler-tube floor 18*a* in order to position the block 16 more than two boiler-tube diameters 18*b* away from the slag tap 14. The threaded fastener 28 enters the recess 38 from the bottom of the block 16 and fits first through the ceramic washer 30 and then through the metal washer 31. The nut 32 screws onto the threaded fastener 28 over the ceramic washer 30 and metal washer 31. The refractory plug 34 is a high-fired, pre-fired refractory material and is mortared into the recess 38 on the top of the block 16.

This securing assembly not only keeps the block 16 in place, but also protects itself from failure due to slag and heat attack. The refractory plug 34 secured into the recess 38 prevents slag from penetrating into the recess 38 and attacking the nut 32, the washers 30,31, and the fastener 28. The ceramic washer 30 acts as a cushion and absorbs thermal expansion of the block 16. This absorption reduces harmful pressure on the metal washer 31 and the nut 32. The chance of the threaded fastener 28 failing due to excessive heat is reduced because the fastener 28 is cooled by the water running through the tube to which the fastener 28 is attached.

The blocks 16, as well as the components of the securing means, are also made available in a kit, allowing the dam 12 to be assembled at the furnace site. When installing the dam 12 to the furnace, the pumpable refractory material 24 and the plastic, rammable refractory 26 are removed from the furnace floor. Because there are no Bailey blocks 20*a* beneath the installed dam 14, it may be necessary, depending on the dam's 12 shape and size, to remove some Bailey blocks 20*a* from the boiler-tube floor 18*a* and weld additional pin studs 22 to the newly exposed tubes.

After the pumpable refractory material 24 and the additional Bailey blocks are removed, the area above the exposed boiler tubes 18*d* is rammed with new plastic, rammable refractory 26. The plastic refractory 26 extends from the slag tap 14 to the top of the first Bailey block 20*b* after the last exposed boiler tube 18*c*. The plastic refractory 26 forms a sloped surface 27 next to the side of the refractory block 16 that is closer to the slag tap 14. This facilitates slag flow to the slag tap 14 and braces the refractory block 16 against the force of the slag flowing toward the slag tap 14.

A ceramic blanket 36 wraps around the outer perimeter of the refractory block 16, and the refractory material 24 is pumped between the outer perimeter of the refractory block 16 to the wall of the furnace. The ceramic blanket 36 absorbs the expansion of the pumpable material 24 as it cures, avoiding imposing excessive loads on the threaded fastener 28.

Advantages

There are several advantage to using this slag dam 12. Because the slag dam 12 comprises refractory blocks 16, the operational problems associated with water-cooled rings (i.e., inadequate cooling flow, seasonal fluctuations in water temperature, and absence of water flow at furnace start-up) are not encountered.

The slag dam 12 also reduces maintenance problems encountered with the water-cooled rings. Because the refractory blocks 16 are more than two boiler-tube diameters 18*b* away from the slag tap 14, the likelihood of damaging the refractory blocks 16 with a tool while burning open a frozen slag tap 14 is reduced. This increased distance also reduces the likelihood of slag bridging the tap 14 closed.

An additional advantage is that the shaped ends of each block 16 are tapered to brace each adjacent refractory block 16 against motion toward the slag tap 14. In this way, even if the threaded fastener 28 fails, the slag dam 12 will retain its closed circuit shape, thereby continuing to hold a constant layer of slag over the pumpable refractory material 24.

Best Mode

The following is a description of materials and techniques that may be useful in practicing this preferred embodiment. Because there are many ways of practicing the embodiment, this is only an example and does not limit the scope of the claims.

In the preferred embodiment, the plastic refractory 26 rammed in the area above the exposed boiler tubes 18*d* is a 70% SiC plastic refractory. The ceramic washer 30 is a SiO ceramic fiber. The ceramic blanket 36 is a SiO material with a thickness of ¼" and is sold commercially as Cerawool and Kaowool. The material of the pin studs 22, the threaded fastener 28, the metal washer 31, and the nut 32 is 310 stainless steel. The nut 32 is torqued on the threaded fastener 28 to 15 foot-pounds and is then tack welded to the threaded fastener 28.

The pumpable refractory material 24 is a high alumina, low moisture, low cement, high strength, pumpable refractory material with about a 8–15% SiC additive. The refractory material 24 is pumped to a 4" high level.

The material of the refractory blocks 16 is a high alumina, low moisture, low cement, high strength, castable refractory material with about a 8–15% SiC additive. An example of this material is Plicast HyMOR 3100 available from Plibrico Company, although other products may be used. The refractory blocks 16 are high fired to about 2,100 degrees Fahrenheit.

The refractory plug 34 is constructed in the same fashion and of the same material as the refractory blocks 16. The refractory plug 34 is 3½" long with a diameter of 2½". The mortar used to secure the plug 34 into the recess 38 is a high alumina (90%) oxide, high-strength mortar mix. Such a mortar is Plibrico's Super Demon Air Set Mortar.

In one embodiment, the refractory block 16 is 10" wide and 8" tall. The recess 38 extends down 5" from the top of the refractory block 16 and has a diameter of 2½"; the recess 38 then narrows to a diameter of ¾" and extends to and through the bottom of the refractory block 16. The center of the recess 38 is positioned 5" from the side of the refractory block 16. In this embodiment, the boiler-tube diameter 18*b* is 3¼", the pin stud 22 diameter is ⅜", and the threaded fastener 28 diameter is ½" with a length of 5½".

Coal was burned in the furnace, but other combustible fuel may be used. The types of furnaces which may be used with this invention include, but are not limited to, Babcock and Wilcox Radiant-type boilers, pre-1965 vintage and ABB Combustion Engineering corner fired wet bottom units, pulp and paper boilers, small industrial units and package boilers using a wet bottom design, and Babcock and Wilcox Universal Pressure-type boilers.

SECOND PREFERRED EMBODIMENT

Figure 3:
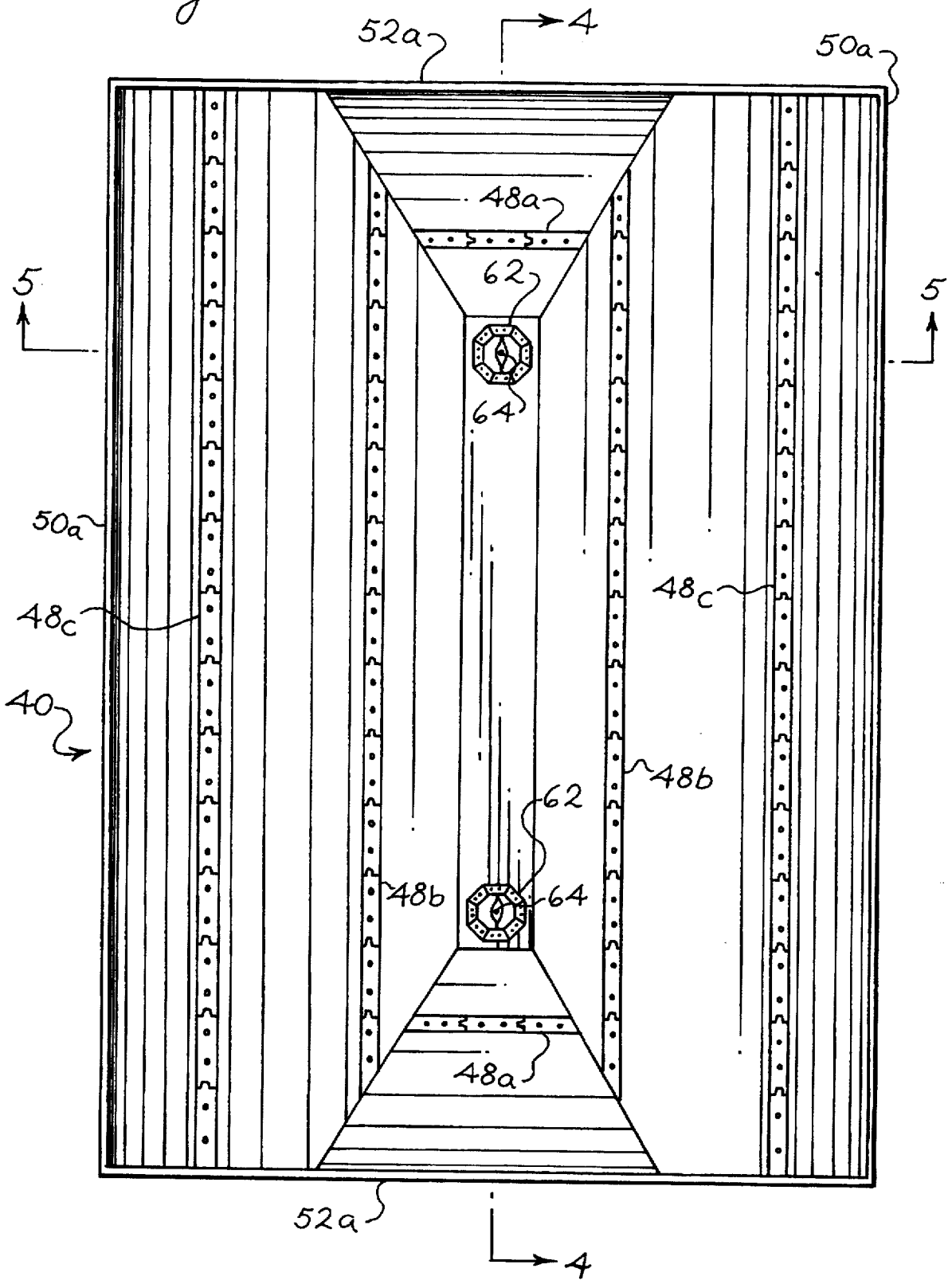
FIG. 3 is a plan view of a second preferred embodiment.

FIG. 3 shows a plan view of a second preferred embodiment. The furnace 40 of the second preferred embodiment has two end floors 52*a* and two side floors 50*a* that slope upwardly from the slag taps 64. The two end floors 52*a* have a greater slope than the two side floors 50*a*. As the end floors 52*a* and the side floors 50*a* extend from slag taps 64, the end floors 52*a* join vertical end walls 52*b* at a transition line 53, and the side floors 50*a* join vertical side walls 50*b* at a transition line 51 (see FIGS. 4 and 5). Metal-studded boiler tubes cover the side floors 50*a* and the end floors 52*a*. A plastic refractory is rammed over the metal-studded boiler tubes.

Figure 7:
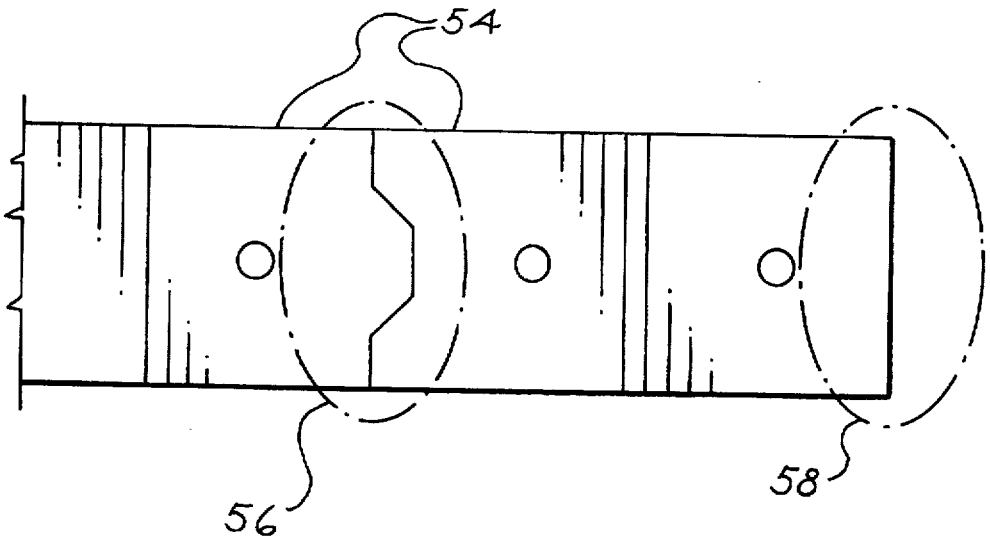
FIG. 7 is an illustration of the interlocking means of the refractory blocks in the second and third preferred embodiments of FIGS. 3–6, showing the preferred shape of the refractory blocks that are placed against vertical end walls.
Figure 8:
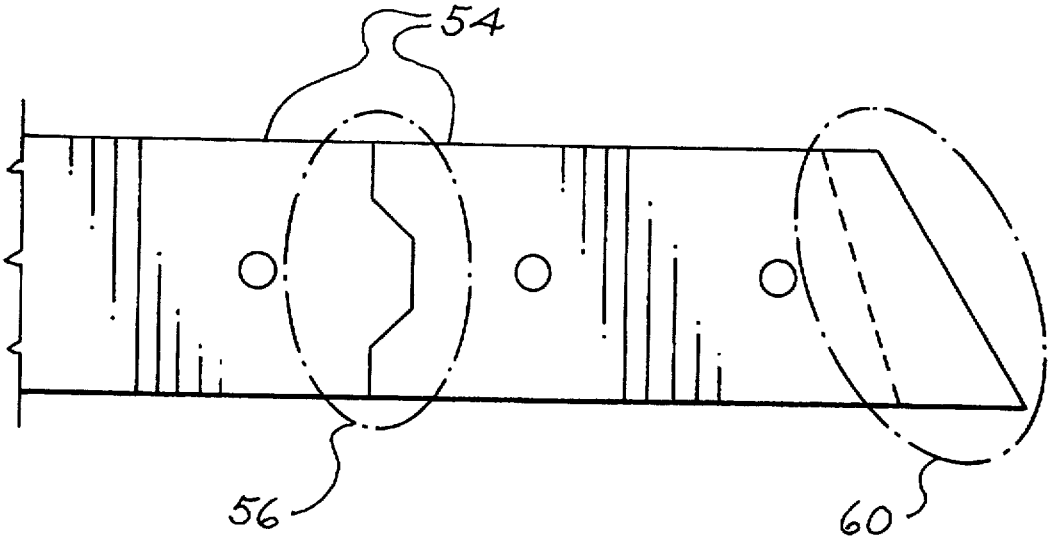
FIG. 8 is an illustration of the interlocking means of the refractory blocks in the second and third embodiments of FIGS. 3–6, showing the preferred shape of the refractory blocks that are placed against side and end floors and that abut other refractory blocks.

The second embodiment of the invention includes dams 62, each substantially identical to dam 12, comprising refractory blocks 54 (See FIGS. 7 and 8). The dams 62 surround the slag taps 64. Additional dams 48*a*, 48*b*, 48*c* are secured to the side floors 50*a* and the end floors 52*a* of the furnace 40 with the means of the first preferred embodiment. In the embodiment shown in FIG. 3, one additional dam 48*a* abuts the two side floors 50*a*, another additional dam 48*b* abuts the two end floors 52*a*, and the other additional dam 48*c* abuts the two vertical end walls 52*b*. Unlike the dams 62 closest to the slag taps 64, the additional dams 48*a*, 48*b*, 48*c* do not form closed circuits but rather form line segments.

FIG. 7 shows that the second preferred embodiment refractory blocks 54 are square cut 58 for placement against the vertical end walls 52*b*, while FIG. 8 shows that the refractory blocks 54 are tapered cut 60 for placement against the side floors 50*a* and the end floors 52*a*. In this embodiment, a tongue-in-groove arrangement 56 secures the blocks 54 against pressure from slag flow toward the slag taps 64.

To install the refractory blocks 54, the plastic refractory is removed from the metal-studded boiler tubes and new plastic refractory is placed on the tube that will position the refractory block 54 and on the two adjacent tubes. The bottoms of the refractory blocks 54 are tapered cut to position the blocks 54 perpendicular to the plane of the furnace slag taps 64. The remainder of the installation process is substantially identical to the installation procedure of the first preferred embodiment.

As with the dams 62, the additional dams 48*a*, 48*b*, 48*c* hold back a protective slag layer over the surfaces of the side floors 50*a* and the end floors 52*a*. Because of the slope of the side floors 50*a* and the end floors 52*a*, a single dam may not be able to hold back enough slag to cover the surfaces of the side floors 50*a* and the end floors 52*a* that are farther away from the slag taps 64.

To protect these surfaces, the additional dams 48*a*, 48*b*, 48*c* are positioned to start building up another layer of slag where the layer built up by a lower dam ends. In this way, a protective layer of slag will cover the entire surface of the side floors 50*a* and the end floors 52*a*.

THIRD PREFERRED EMBODIMENT

Figure 4:
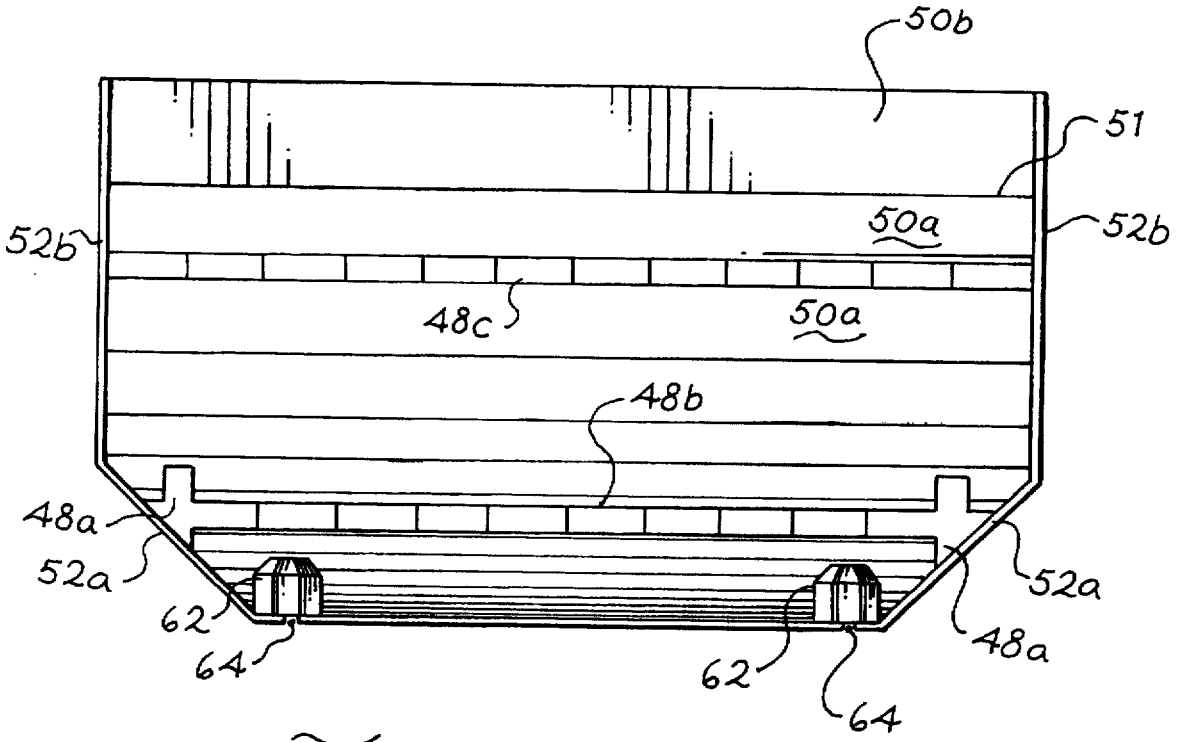
FIG. 4 is a sectional view taken along line 4—4 of FIG. 3.
Figure 5:
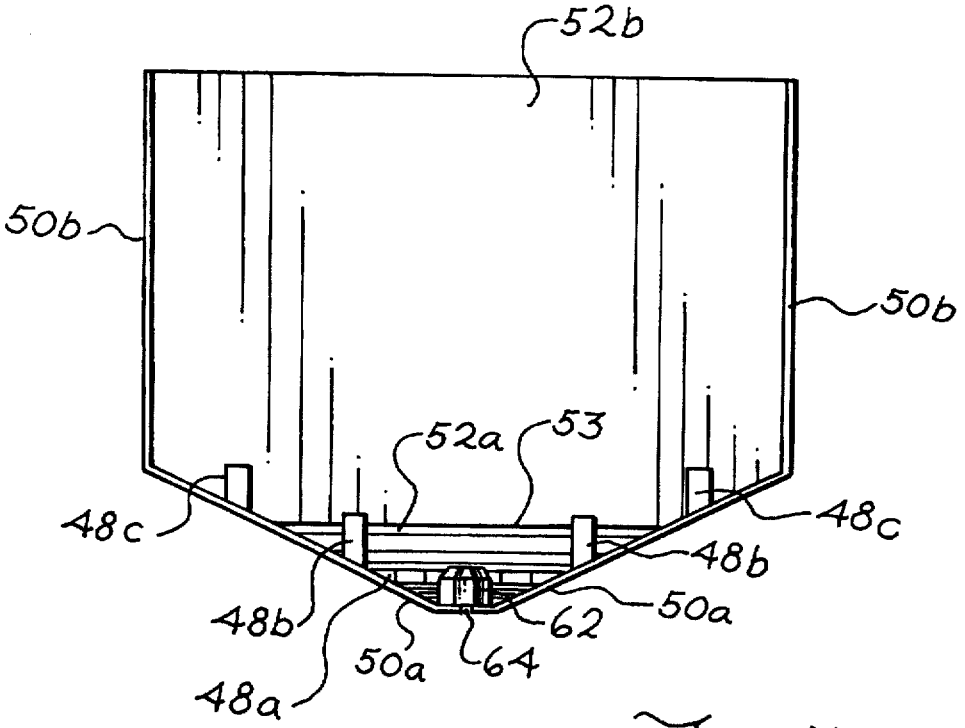
FIG. 5 is a sectional view taken along line 5—5 of FIG. 3.
Figure 6:
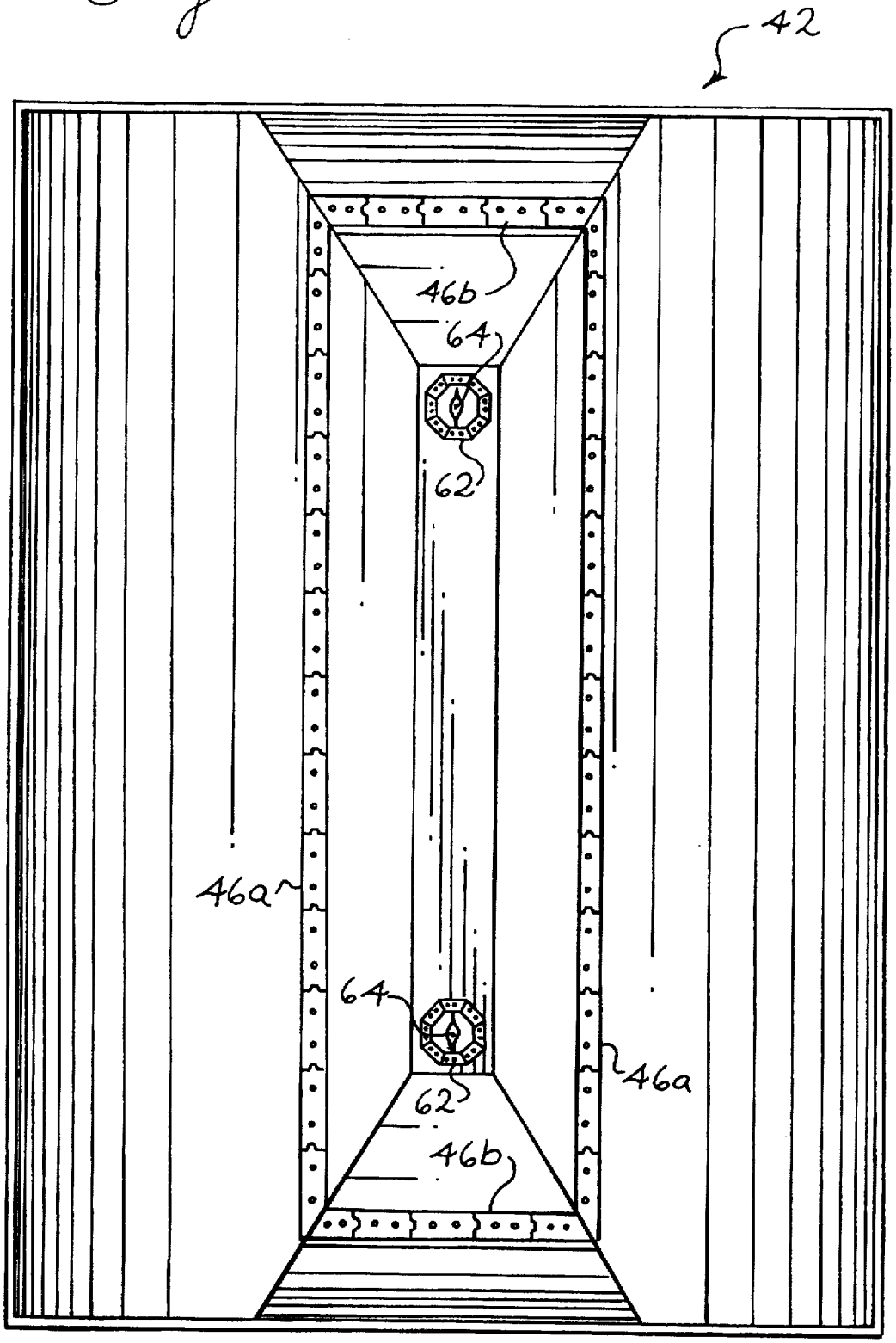
FIG. 6 is a plan view of a third preferred embodiment.

A third preferred embodiment, shown in FIG. 6, is installed in a furnace 42 that is constructed identically to the furnace 40 of FIGS. 4 and 5. The refractory blocks 54 of the additional dams 46*a*, 46*b* are secured and installed as in the first and second preferred embodiments. The refractory blocks 54 at both ends of the additional dams 46*a*, however, are tapered to abut respective refractory blocks 16 at both ends of the other additional dam 46*b*. Intrinsically, the additional dams 46*a*, 46*b* and the dams 62 are nested around the slag taps 64.

FIGS. 7 and 8 show how the refractory blocks 54 of the second and third preferred embodiments are interlocked. As in the second preferred embodiment, a tongue-in-groove arrangement 56 secures the blocks 54 against pressure from slag flow toward the slag tap 64.

The type of furnace of the second and third embodiments includes, but is not limited to, Babcock and Wilcox Universal Pressure-type boilers.

ALTERNATIVES

Based upon the type of combustible fuel that is being burned, the material of the refractory blocks 16 can also be (1) a high alumina, low moisture, no or low cement, high strength, castable refractory material with about a 8–10% chrome-oxide additive or (2) a high alumina, magnesia-alumina spinel, no or low cement castable material with about a 5–8% magnesia-oxide additive. The second alternative is available from Martin Marietta as Marcast 561 or Marcast 92-Spinel. Other refractory materials may also be used.

Examples of interconnections of the refractory blocks 54 in addition to the tongue-in-groove shape 56 include, but are not limited to, half-round, sinusoidal, and saw tooth shapes.

In place of Bailey blocks 20*a*, blocks of pre-fired refractory material may be used. 310 stainless steel was used for the components of the securing means because of its cost and availability, but other metals that would survive the furnace conditions can be used. While specific dimensions and securing components were described, shapes, sizes, and components may be varied.

It is intended that the foregoing detailed description be understood as an illustration of selected forms that the invention can take and not as a definition of the invention. It is only the following claims, including all equivalents, which are intended to define the scope of this invention.

What is claimed is:

1. In a furnace having a slag tap and a refractory covered, boiler-tube floor, the improvement comprising a dam comprising a plurality of adjacent refractory blocks mechanically secured to the refractory covered, boiler-tube floor near the slag tap, said dam being positioned away from and extending around the slag tap.

2. A dam surrounding a slag tap on a refractory covered, boiler-tube floor, the dam comprising a plurality of adjacent refractory blocks mechanically secured to the refractory covered, boiler-tube floor near the slag tap, said dam being positioned away from and extending around the slag tap.

3. The invention of claim 1 or 2, wherein the dam is shaped to form a closed circuit extending around the slag tap, and wherein the refractory blocks are shaped to brace adjacent refractory blocks against motion toward the slag tap.

4. The invention of claim 1, wherein the dam comprises a first closed circuit extending around the slag tap, and wherein the invention further comprises at least one additional dam, each additional dam comprising a respective additional closed circuit comprising a respective plurality of adjacent refractory blocks mechanically secured to the refractory covered, boiler-tube floor, the first closed circuit and each additional closed circuit extending around and being nested around the slag tap.

5. The invention of claim 1, wherein the dam comprises a closed circuit extending around the slag tap, and wherein the invention further comprises at least one additional dam, each additional dam comprising a respective plurality of adjacent refractory blocks mechanically secured to the refractory covered, boiler-tube floor, each respective additional dam being positioned increasingly farther away from the slag tap.

6. The invention of claim 1, 2, 4, or 5, wherein at least one of the refractory blocks is mechanically interlocked with at least one adjacent refractory block.

7. The invention of claim 4, wherein each refractory block of the first closed circuit is shaped to brace each adjacent refractory block against motion toward the slag tap.

8. The invention of claim 5, wherein each refractory block of the closed circuit is shaped to brace each adjacent refractory block against motion toward the slag tap.

9. The invention of claim 1, 2, 4, or 5 further comprising means for securing the refractory blocks to the refractory covered, boiler-tube floor.

10. The invention of claim 1, 2, 4, or 5, wherein each block comprises at least one recess, and wherein the invention further comprises:

a plurality of threaded fasteners attached to the boiler tubes, each threaded fastener extending into a respective one of the recesses; and a plurality of refractory plugs, each disposed in a respective one of the recesses over the respective threaded fastener.

11. The invention of claim 1, 2, 4, or 5, wherein each block comprises at least one recess, and wherein the invention further comprises:

a plurality of threaded studs welded to the boiler tubes, each threaded stud extending into a respective one of the recesses;

a plurality of nuts, each disposed in a respective one of the recesses securing the respective refractory block to the respective threaded stud; and a plurality of refractory plugs, each mortared into a respective one of the plurality of recesses over the respective nut.

12. The invention of claim 1, 2, 4, or 5, wherein the refractory blocks are sufficiently distanced from the slag tap to reduce damage to the blocks during maintenance of the slag tap.

13. The invention of claim 1, 2, 4, or 5, wherein at least some of the refractory blocks are distanced from the slag tap by more than about 7½ inches.

14. The invention of claim 1, 2, 4, or 5, wherein the refractory blocks comprise a pre-fired refractory material.

15. The invention of claim 1, wherein the dam comprises a first closed circuit extending around the slag tap, and wherein the invention further comprises an additional closed-circuit dam, the additional closed-circuit dam comprising a respective plurality of adjacent refractory blocks mechanically secured to the refractory covered, boiler-tube floor, the first closed circuit and the additional closed circuit extending around and being nested around the slag tap.

16. The invention of claim 1, wherein the boiler-tube floor includes an end floor and a side floor, wherein the dam comprises a closed circuit extending around the slag tap, and wherein the invention further comprises at least one line-segment dam, each line-segment dam comprising a respective plurality of adjacent refractory blocks mechanically secured to the refractory covered, boiler-tube floor, each respective line segment being positioned increasingly farther away from the slag tap along the respective end floor or side floor.

17. In a furnace having a slag tap and a refractory covered, boiler-tube floor, the improvement comprising a dam comprising a plurality of adjacent refractory blocks mechanically secured to the refractory covered, boiler-tube floor, said dam positioned away from the slag tap on the refractory covered, boiler-tube floor to impede a flow of slag to the slag tap.

18. A dam surrounding a slag tap on a refractory covered, boiler-tube floor, the dam comprising a plurality of adjacent refractory blocks mechanically secured to the refractory covered, boiler-tube floor, said dam positioned away from the slag tap on the refractory covered, boiler-tube floor to impede a flow of slag to the slag tap.

19. The invention of claim 1, 2, 17, or 18, wherein said dam is positioned away from the slag tap by a distance sufficient to reduce damage to said dam during maintenance of the slag tap.

20. The invention of claim 1, 2, 17, or 18, wherein said dam is free from a drain trough overhanging the slag tap.

* * * * *